US007126451B2

(12) United States Patent
Maruyama

(10) Patent No.: US 7,126,451 B2
(45) Date of Patent: Oct. 24, 2006

(54) PROCESS FOR THE PREPARATION OF COIL FOR ELECTRIC APPLIANCE AND COIL FOR ELECTRIC APPLIANCE

(75) Inventor: Jiro Maruyama, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 96 days.

(21) Appl. No.: 10/924,821

(22) Filed: Aug. 25, 2004

(65) Prior Publication Data

US 2005/0046538 A1 Mar. 3, 2005

(30) Foreign Application Priority Data

Aug. 27, 2003 (JP) ..... 2003-209005

(51) Int. Cl.
*H91F 5/00* (2006.01)

(52) U.S. Cl. ..... 336/200; 336/223; 336/232; 29/602.1

(58) Field of Classification Search ..... 310/201, 310/208; 336/200, 223, 232; 29/602.1, 29/605–606

See application file for complete search history.

(56) References Cited

U.S. PATENT DOCUMENTS 3,566,171 A * 2/1971 Tichy et al. ..... 310/180
4,095,333 A * 6/1978 Kuter et al. ..... 29/598
4,839,771 A * 6/1989 Covey ..... 361/218
5,065,059 A * 11/1991 Adams et al. ..... 310/71
5,274,904 A * 1/1994 Proise ..... 29/602.1
5,376,911 A * 12/1994 Stenkvist ..... 336/60
6,269,531 B1 * 8/2001 Mercado et al. ..... 29/602.1
6,445,272 B1 * 9/2002 Mercado et al. ..... 336/225

FOREIGN PATENT DOCUMENTS

JP 01274633 A * 11/1989
JP 06231977 A * 8/1994
JP 2001-178052 6/2001

* cited by examiner

*Primary Examiner*—Anh Mai
(74) *Attorney, Agent, or Firm*—Smith, Gambrell & Russell, LLP

(57) ABSTRACT

The present invention is to provide a process for the preparation of coil for an electric appliance by which a coil for electric appliances comprising an edgewise wound square coil having small intervals between coils and high quality can be easily prepared in good productivity and low-cost. The coil for electric appliance comprising edgewise wound square coil 11 is prepared by processing mechanically an electrically conductive flat plate to form plural strip-shaped coil fragments 1A to 1E, butting ends of the coil fragments 1A to 1E each other and welding the ends by beam to form plural one-turn square coils, each of the one-turn square coils having a ring-shape provided with a beginning end 2A and a terminal end 2B divided by a notch 3 whose location is different from one another in the one-turn square coils, and superposing the one-turn square coils on one another with shifting the locations of the notches 3 little by little in order so that the terminal and beginning ends of the one-turn square coils adjacent to each other are contact with each other to weld the terminal and beginning ends in the notch 3, whereby the one-turn square coils are spirally combined.

17 Claims, 7 Drawing Sheets

PROCESS FOR THE PREPARATION OF COIL FOR ELECTRIC APPLIANCE AND COIL FOR ELECTRIC APPLIANCE

BACKGROUND OF THE INVENTION

1. Field of the Invention

The present invention relates to a process for the preparation of a coil for an electric appliance useful in electric appliances such as rotating apparatuses (e.g., a motor or generator) or transformers and a coil for electric appliance.

2. Description of the Related Art

For example, there has been known an edgewise wound square coil as a coil for motor, the square coil being obtained by squarely winding an electric conductor having a rectangular cross section such that small sides of the cross section corresponds with the direction of the coil axis of the coil to helically superpose the wound conductor in the direction of the coil axis.

Such the edgewise wound square coil permits a proportion occupied by coil in a slot to enhance. Hence in the edgewise wound square coil, it is possible to increase the operation efficiency of a motor and also reduce the size and weight of the motor.

The edgewise wound square coil has been prepared, for example, as shown in FIG. 12 so far. In more detail, a pillar copper is cut to form strip-shaped coil fragments 51A to 51D for constituting a one-turn square coil, the edges of the coil fragments 51A to 51D are butted (i.e., brought into contact with) each other in order at three points and welded respectively in bonding portions 52 to form a one-turn square coil 51 in the form of circle (rectangle), and a terminal end 53 of the one-turn square coil 51 is brazed to a beginning end of another (next) one-turn square coil 51 prepared similarly, whereby a square coil having desired number of turns can be prepared. For example, the process is described in JP-A-2001-178052.

According to the above-mentioned process, the pillar copper is cut to form strip-shaped coil fragments 51A to 51D, and therefore it is expected that the coil fragments 51A to 51D is improved in processing properties and processing precision and further enhanced in material yield of the pillar copper resulting in good productivity and low-cost.

SUMMARY OF THE INVENTION

In the process disclosed in JP-A-2001-178052, the welding of the strip-shaped coil fragments 51A to 51D in the bonding portions 52 to form the one-turn square coil 51, and the bonding of the terminal end 53 of the one-turn square coil 51 and the beginning end of the next one-turn square coil 51 are carried out by brazing.

Therefore, when the strip-shaped coil fragments 51A to 51D are brought into contact with each other to be brazed, padding by the brazing is formed on a surface of the brazed portion (i.e., a surface in the direction of a coil axis). Hence, it is required that is an interval between coils increase by the padding, whereby a proportion occupied by coil lowers.

Further, in case the ends of the strip-shaped coil fragments 51A to 51D are superposed on each other to be brazed, an interval between coils increases by a thickness of plate of the superposed fragment, whereby a portion occupied by coil lowers.

Furthermore, in the above process, since all the one-turn square coils 51 are brazed to one another at the same position, the brazed positions of all the one-turn square coils 51 are linearly arranged in the direction of coil axis. Hence, it is difficult to accurately braze all the one-turn square coils 51, and therefore the quality of a coil for motor is apt to lower.

In more detail, if the brazing is carried out using excessive amount of braze to firmly bond the adjacent one-turn square coils 51, braze for the brazing is apt to reach to an already bonded portion of another one-turn square coil 51 located under the coil 51 to be brazed, whereby the one-turn square coils 51 cause short-circuit not to provide a coil having desired effective number of turns.

Contrary to the above case, if the brazing is carried out so as not to cause short-circuit to the one-turn square coils 51, unconnected parts in portions to be brazed are generated and sufficient bonding strength cannot be obtained. Thus the reduction of the bonded area caused by increase of unconnected area brings about increase of current density in the bonded portion to make attainment of the predetermined performance impossible, whereby the quality of the resultant square coil is apt to lower.

However, in order to resolve the above problems, it is considered that the edges of the coil fragments 51A to 51D or one-turn square coils 51 are brought into contact with each other and welded by beam respectively. Thereby the welding scarcely brings about formation of padding, and therefore it is possible to minimize the interval between coils and to enhance the proportion occupied by coil.

However, though the above process is effective when the edges of the coil fragments 51A to 51D are brought into contact with and bonded to form a one-turn square coil, it is not effective when the terminal and beginning edges of the one-turn square coils 51 are brought into contact with and welded by beam. In more detail, the welded portions of the one-turn square coils 51 welded by beam as above are linearly arranged in the direction of coil axis, and therefore excess welding by beam brings about bonding of a one-turn square coil 51 to be bonded to an already bonded portion of another one-turn square coil 51 located under the coil 51, whereby short-circuit between the one-turn square coils 51 occurs not to provide a coil having desired effective number of turns. Contrary to this, if the welding is carried out so as not to cause the short-circuit, the beam welding is not sufficiently carried out and therefore satisfactory bonding strength cannot obtained. Simultaneously the reduction of the bonded area by occurrence of unconnected portion brings about increase of current density in the bonded portion to make attainment of the predetermined performance impossible, whereby the quality of the resultant square coil is apt to lower.

For the reasons, even if the beam welding through the contact is adopted, it is difficult to carry out precisely beam welding of the one-turn square coils 51 whereby the quality of a coil for motor is apt to lower.

The above lowering of quality is generated in the preparation of not only the coil of motor but also coils used in other electric appliances such as transformers.

Accordingly, in view of the above problems, the object of the present invention is to provide a process for the preparation of coil for an electric appliance by which a coil for electric appliances comprising an edgewise wound square coil having small intervals between coils and high quality can be easily prepared in good productivity and low-cost.

Further the object of the present invention is to provide a coil for electric appliance comprising an edgewise wound square coil having small intervals between coils and high quality, which can be easily prepared in good productivity and low-cost.

The present invention (first invention) to attain the object is provided by a process for the preparation of a coil for an electric appliance by squarely winding an electric conductor having a rectangular cross section such that small sides of the cross section corresponds with the direction of the coil axis of the coil to helically superpose the conductor, comprising the steps of:

processing mechanically an electrically conductive flat plate to form plural strip-shaped coil fragments;

butting ends of the coil fragments each other and beam welding the ends to form plural one-turn square coils having notches whose locations differs from one another, each of the one-turn square coils having a ring-shape (generally a shape of rectangular frame) provided with a beginning end and a terminal end divided by the notch; and superposing the one-turn square coils on one another while shifting the locations of the notches little by little in order so that the terminal and beginning ends of the one-turn square coils adjacent to each other are in contact with each other to weld or braze the terminal and beginning ends, whereby the one-turn square coils are spirally bonded.

According to the first invention, since an electrically conductive flat plate is mechanically processed to plural strip-shaped coil fragments, it is possible to enhance the processing properties and processing accuracy of the coil fragments and simultaneously to improve the productivity and manufacturing cost due to enhancement of yield of material for an electrically conductive plate. Further, the ends of the coil fragments are butted (brought into contact with) each other and welded, which results in the formation of plural one-turn square coils having a ring-shape, and hence it is possible to easily and firmly bond the adjacent coil fragments without formation of padding by brazing. Furthermore, the one-turn square coils are superposed on one another while shifting the locations of the notches little by little in order and the terminal and beginning ends adjacent to each other are welded or brazed, and hence the bonded portions of one-turn square coils are not superposed on one another in the direction of coil axis. For the reasons, there is no occurrence of short-circuit between the adjacent one-turn square coils during the bonding procedure, and it is possible to easily prepare a coil for electric appliances comprising an edgewise wound square coil having small intervals between coils and high quality in good productivity and low-cost.

The preferred embodiment (1) of the first invention is provided by the process for the preparation of coil for an electric appliance, the formation of the strip-shaped coil fragments being carried out by cutting an electrically conductive flat plate in the form of band in a desired length; and the formed plural one-turn square coils having the same outer size as one another.

According to the preferred embodiment (1), since the formation of the strip-shaped coil fragments is carried out by cutting an electrically conductive flat plate in the form of band and consequently plural one-turn square coils having the same outer size as one another is obtained, it is possible to enhance the processing properties and productivity of the coil fragments and to prepare easily and in low-cost the coils for electric appliances comprising an edgewise wound square coil having prism-shaped appearance.

The preferred embodiment (2) of the first invention is provided by the process for the preparation of coil for an electric appliance, the formation of the strip-shaped coil fragments being carried out by cutting plural electrically conductive flat plates having different thickness from one another to form plural strip-shaped coil fragments having the approximately same sectional area as one another;

the formation of the plural one-turn square coils being carried out by butting ends of coil fragments having the same thickness as one another with each other and welding the ends by beam welding to form plural one-turn square coils, the one-turn square coils having an outer size different from one another and different location of the notch from one another; and the bonding of the one-turn square coils being carried out by superposing the one-turn square coils on one another while shifting the locations of the notches little by little with increase or decrease of outer sizes of the square coils to weld or braze the terminal and beginning ends of the one-turn square coils adjacent to each other, whereby the one-turn square coils are spirally bonded.

According to the preferred embodiment (2), it is possible to easily preparing in low-cost the square coil increased or decreased in the outer sizes of the square coils with movement of the one-turn square coils in the direction of coil axis. By using such the square coil in, for example, a stator coil of a motor, it is possible to reduce the size and weight of the motor due to enhancement of the proportion occupied by coil and operation efficiency of a motor. Similarly, the use of the square coil in other electric appliances enables the reduction of size and weight of the appliances.

The preferred embodiment (3) of the first invention is provided by the process for the preparation of coil for an electric appliance, the formation of the plural strip-shaped coil fragments being carried out by cutting plural electrically conductive flat plates in the form of band in a desired length, the plural electrically conductive flat plates having thickness different from one another and the approximately same sectional area as one another.

In the invention defined by the above preferred embodiment (2), the preferred embodiment (3) enables the preparation of the coil fragments having thickness different from one another and the approximately same section area as one another in good processing and productivity.

The present invention (second invention) to attain the object is provided by a coil for an electric appliance obtained by squarely winding an electric conductor having a rectangular cross section such that small sides of the cross section correspond with the direction of the coil axis of the coil to helically superpose the conductor, comprising:

plural one-turn square coils obtained by butting ends of the strip-shaped coil fragments made of an electrically conductive flat plate each other in order and beam welding the end, the plural one-turn square coils having notches whose locations differs from one another and each of the one-turn square coils having a ring-shape provided with a beginning end and a terminal end divided by the notch, the plural one-turn square coils being superposed on one another while shifting the locations of the notches little by little so that the terminal and beginning ends of the one-turn square coils adjacent to each other are in contact with each other to weld or braze the terminal and beginning ends, whereby the one-turn square coils are spirally and continuously bonded.

According to the second invention, the coil for electric appliance is constructed by butting ends of the strip-shaped coil fragments made of an electrically conductive flat plate each other in order and welding the ends by beam to form plural one-turn square coils whose locations differs from one another and each of the one-turn square coils having a ring-shape provided with a beginning end and a terminal end divided by the notch, and superposing the plural one-turn square coils while shifting the locations of the notches little by little such that the terminal and beginning ends of the one-turn square coils adjacent to each other are in contact with each other to weld or braze the terminal and beginning ends, whereby the one-turn square coils are spirally and continuously combined. Therefore, the plural strip-shaped coil fragments can be easily obtained by mechanically processing the electrically conductive flat plate, and the processing properties and processing precision of the coil fragments can be improved. Simultaneously, the material yield of the electrically conductive flat plate is improved to bring about enhancement of the conductivity and reduction of the manufacturing cost. Further, since the plural one-turn square coils are superposed on one another with shifting the locations of the notches little by little such that the terminal and beginning ends of the one-turn square coils adjacent to each other are in contact with each other to weld or braze the terminal and beginning ends, it is possible to easily prepare coils for electric appliances comprising an edgewise wound square coil having high quality and small intervals between coils in good productivity and low-cost.

DETAILED DESCRIPTION OF THE INVENTION

Embodiments relating to the process for the preparation of a coil for electric appliance and the coil for electric appliance according to the present invention are explained by reference of the drawings.

First Embodiment

Figure 1:
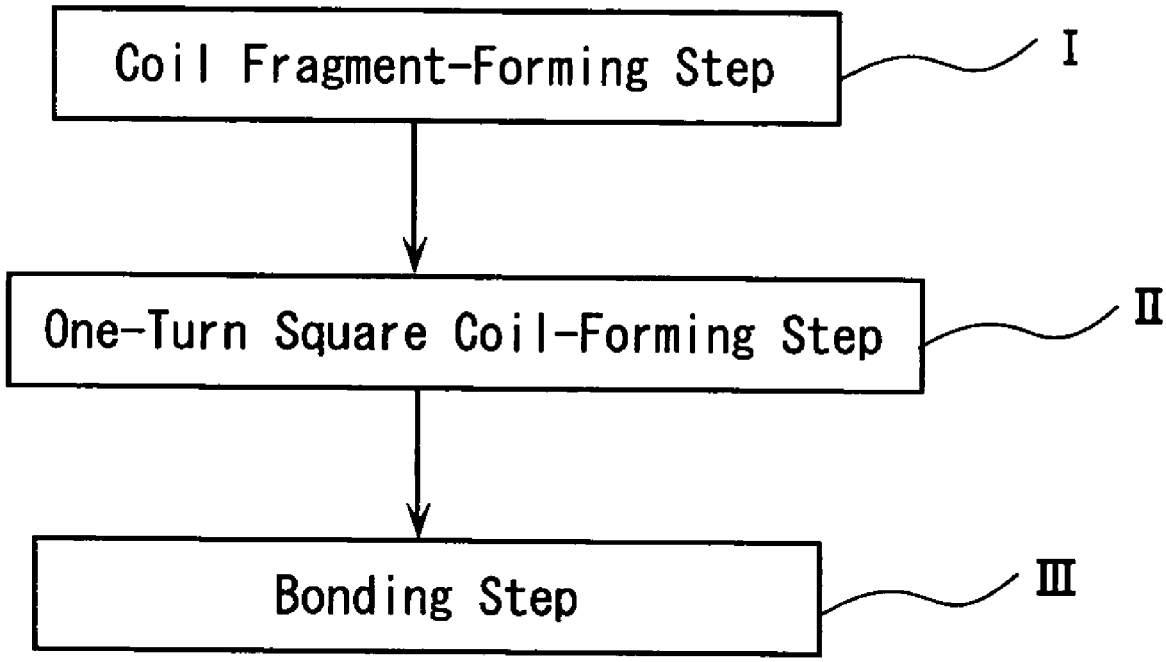
FIG. 1 is a view showing sequential steps for explaining a first embodiment according to the present invention.
Figure 2:
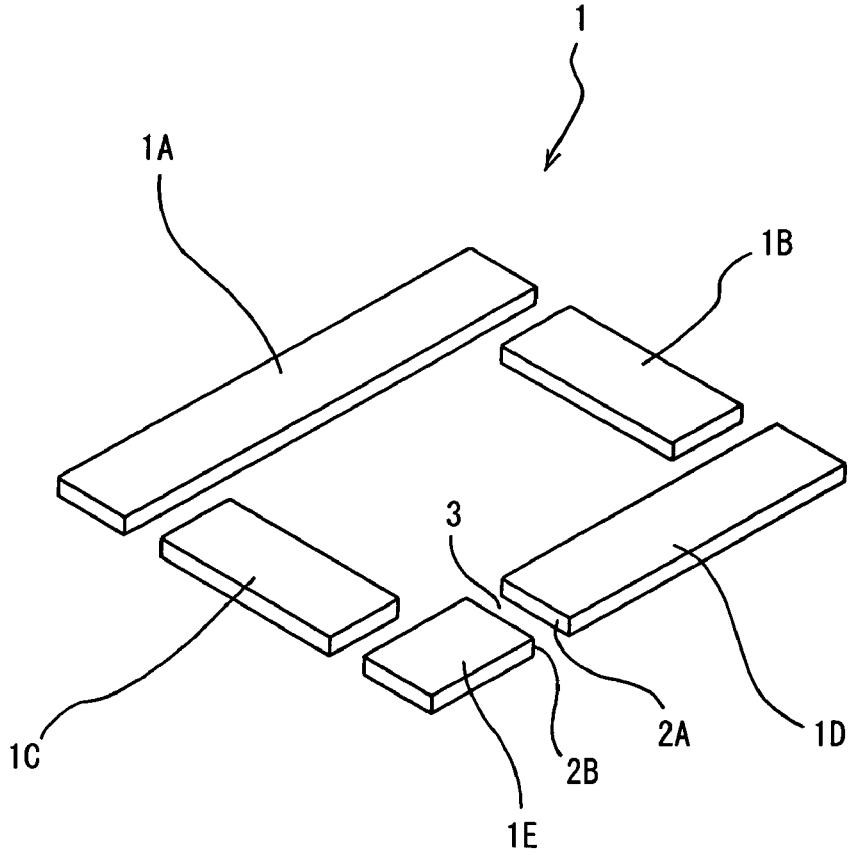
FIG. 2 is a perspective view coil showing coil fragments formed in a coil fragment-forming step in the first embodiment.
Figure 3:
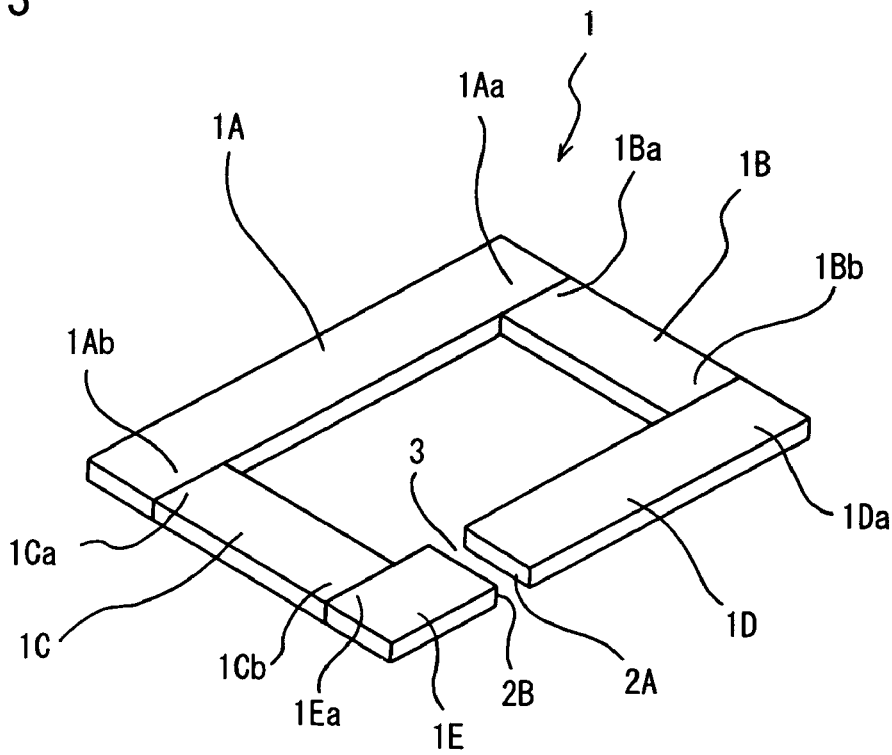
FIG. 3 is a perspective view coil showing a one-turn square coil formed in a one-turn square coil-forming step in the first embodiment.
Figure 4:
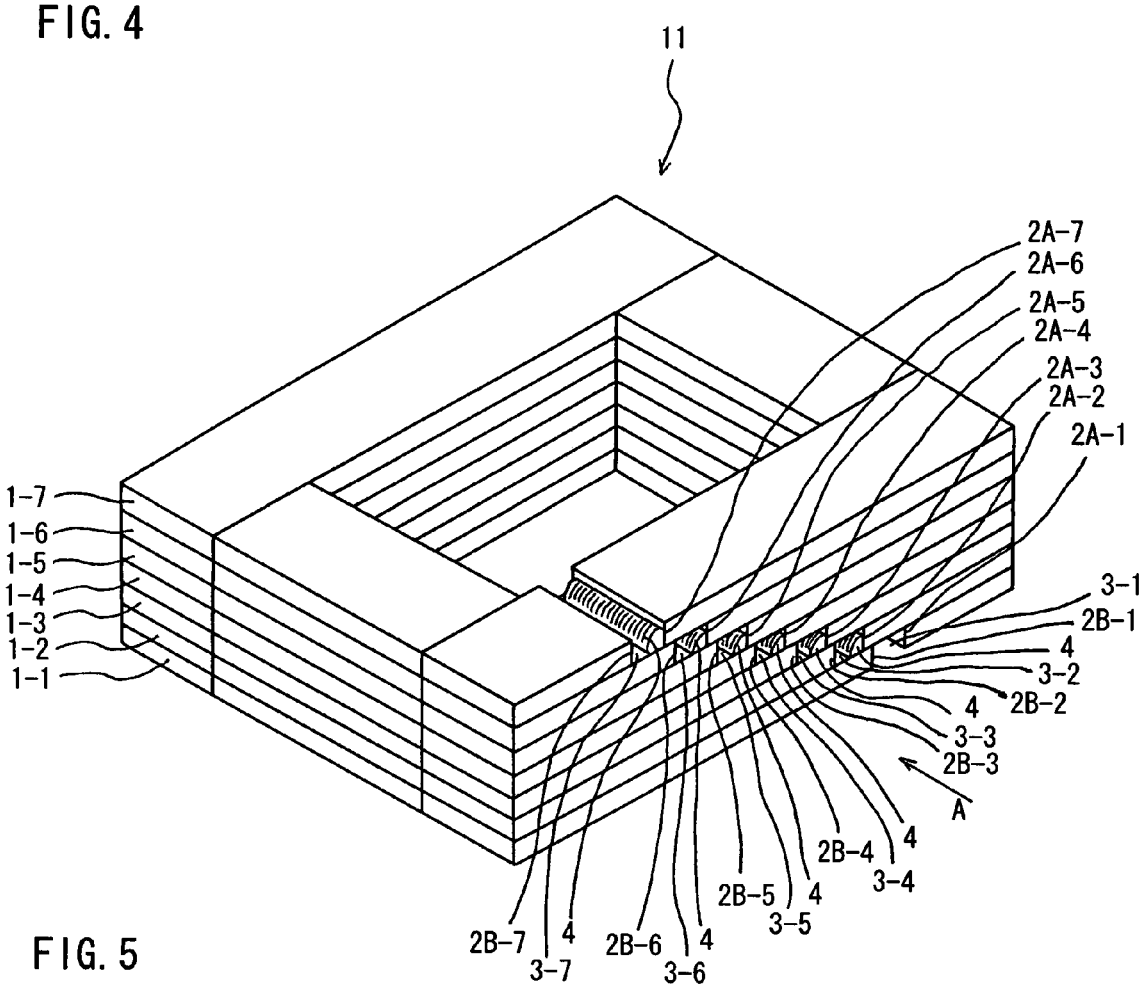
FIG. 4 is a perspective view coil showing an example of a square coil formed in a bonding step in the first embodiment.
Figure 5:
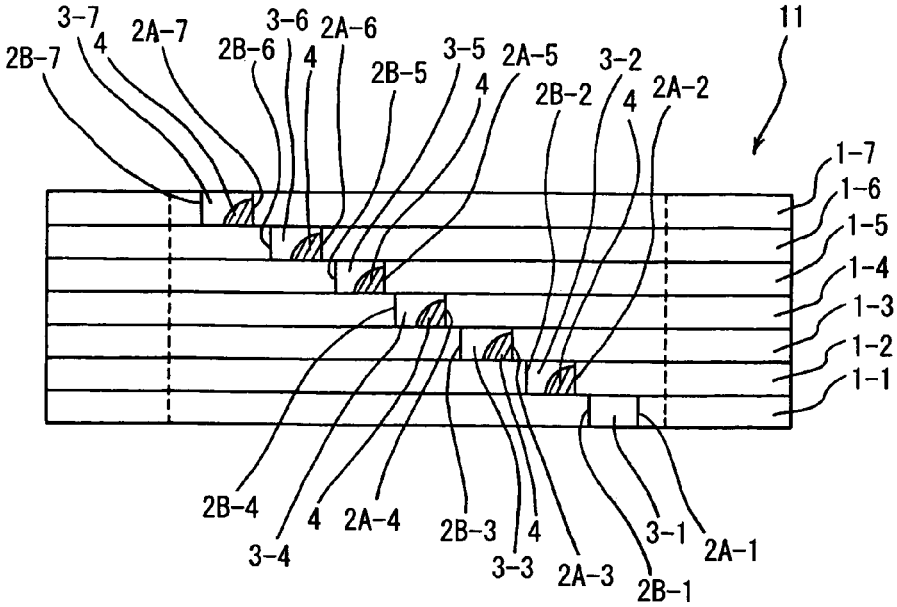
FIG. 5 is a view obtained by viewing FIG. 4 from an arrow A.

FIGS. 1 to 5 show the first embodiment of the invention. FIG. 1 is a view showing sequential steps of the first embodiment, FIG. 2 is a perspective view coil showing coil fragments formed in a coil fragment-forming step, FIG. 3 is a perspective view coil showing a one-turn square coil formed in a one-turn square coil forming step, FIG. 4 is a perspective view coil showing an example of a square coil formed in a bonding step, and FIG. 5 is a view obtained by viewing FIG. 4 from an arrow A.

In the first embodiment, as shown in FIG. 1, a coil fragment-forming step I, a one-turn square coil-forming step II, and a bonding step III are carried out in order. In more detail, an edgewise wound square coil can be obtained by winding squarely (i.e., in the form of rectangle) an electric conductor having a rectangular cross section such that small sides of the cross section corresponds with the direction of axis of the coil and consequently helically superposing the conductor. Each of the above steps is explained in detail below.

In the coil fragment-forming step I, an electrically conductive flat plate, made of metal such as copper or aluminum, having a cross section of rectangle and band-shape is cut in the desired length to prepare five strip-shaped coil fragments 1A to 1E, which forms a one-turn square coil 1, as shown in FIG. 2.

The coil fragment 1A forms one long side of the square coil 1, the coil fragments 1B and 1C each form short sides of the square coil 1, and the coil fragments 1D and 1E form the other long side of the square coil 1.

The coil fragments 1D and 1E constituting the other long side are arranged so as to be faced to each other through a notch 3. The total length of the coil fragments 1D and 1E is shorter by the length of the notch 3 than that of the other long side. All the one-turn square coils are provided with coil fragments 1D and 1E having lengths different from one another so as to have different locations of the notches from one another. In more detail, each one-turn square coil is designed so as to have coil fragments 1D and 1E having lengths different from those of the other square coils.

In this explanation, conveniently, an edge face of the coil fragment 1D of the one-turn square coil is referred to as a beginning end 2A, and an edge face of the coil fragment 1E is referred to as a terminal end 2B, the beginning end 2A and the terminal end 2B being faced to each other through the notch 3.

Subsequently, in the one-turn square coil-forming step II, as shown in FIG. 3, the strip-shaped coil fragments 1A to 1E prepared in the coil fragment-forming step I are bonded to one another such that the long coil fragment 1A and the long coil fragments 1D and 1E are faced to each other through the short coil fragments 1B and 1C. In more detail, an edge face of one end 1Ba of the coil fragment 1B is brought into contact with a side of one end 1Aa of the coil fragment 1A by butting them, and an edge face of the other end 1Bb is butted with a side of an end 1Da of the coil fragment 1D, which is opposite to the beginning end 2A of the coil fragment 1D. Similarly, an edge face of one end 1Ca of the coil fragment 1C is brought into contact with a side of the other end 1Ab of the coil fragment 1A, and an edge face of the other end 1Cb is brought into contact with a side of an end 1Ea of the coil fragment 1E, which is opposite to the terminal end 2B of the coil fragment 1E.

The following sides brought into contact with each other by butting as above, i.e., the edge face of one end 1Ba of the coil fragment 1B and the side of one end 1Aa of the coil fragment 1A, the edge face of the other end 1Bb of the coil fragment 1B and the side of an end 1Da of the coil fragment 1D, the edge face of one end 1Ca of the coil fragment 1C and the side of the other end 1Ab of the coil fragment 1A, and the edge face of the other end 1Cb of the coil fragment 1C and the side of an end 1Ea of the coil fragment 1E, are each welded to each other by beam welding to form the one-turn square coil 1 having a ring-shape provided with a beginning end 2A and a terminal end 2B divided by the notch 3, the ring-shape being formed by continuously connecting the coil fragments 1D, 1B, 1A, 1C and 1E. Similarly, plural one-turn square coils 1 having the notches 3 formed by the beginning end 2A and terminal end 2B, in which the locations of the notches are different from one another but the outer sizes of the square coils are the same as one another, are prepared.

Subsequently, in the bonding step III, the plural one-turn square coils 1 prepared in the one-turn square coil forming step II are superposed on one another by shifting the locations of the notches 3 little by little in order so that the beginning ends 2A and the terminal ends 2B of the one-turn square coils 1 adjacent to each other (i.e., the terminal end 2B of the one-turn square coil 1 and the beginning end 2A of the adjacent one-turn square coil 1) are contact with each other to bond the terminal and beginning ends in each of the notches 3 by bonding means 4 such as fillet weld or brazing, whereby the edgewise wound square coil in which the one-turn square coils 1 are continuously and spirally combined in the direction of coil axis is prepared.

In more detail, as shown in FIGS. 4 and 5, for example, in case of spirally bonding seven one-turn square coils 1-1 to 1-7 to prepare a square coil 11, the seven one-turn square coils 1-1 to 1-7 are arranged and superposed such that their notches 3-1 to 3-7 are shifted little by little in order with movement from the one-turn square coil 1-1 to the one-turn square coil 1-7, and such that the terminal end of the one-turn square coil and the beginning end of the next one-turn square coil 1 are contact with each other.

As mentioned above, first, the one-turn square coil 1-2 is superposed on the one-turn square coil 1-1 such that the terminal end 2B-1 of the one-turn square coil 1-1 and the beginning end 2A-2 of the next one-turn square coil 1-2 are contact with each other, and then the terminal end 2B-1 and the beginning end 2A-2 are bonded in a notch 3-2 of the one-turn square coil 1-2 by bonding means 4 such as fillet weld or brazing.

Similarly, the one-turn square coil 1-3 is superposed on the one-turn square coil 1-2 such that the terminal end 2B-2 of the one-turn square coil 1-2 and the beginning end 2A-3 of the next one-turn square coil 1-3 are contact with each other, and then the terminal end 2B-2 and the beginning end 2A-3 are bonded in a notch 3-3 of the one-turn square coil 1-3 by bonding means 4 such as fillet weld or brazing.

The above bonding processing is carried out in every case of superposing each of the one-turn square coils 1-4 to 1-7. Thus the one-turn square coils 1-1 to 1-7 are superposed and spirally bonded, whereby a square coil 11 having prism-shaped appearance is prepared. Thereafter each gap between two of the one-turn square coils 1-1 to 1-7 is subjected to insulation treatment according to a known process.

The following sides brought into contact with each other by butting in the one-turn square coil forming step II, i.e., the edge face of one end 1Ba of the coil fragment 1B and the side of one end 1Aa of the coil fragment 1A, the edge face of the other end 1Bb of the coil fragment 1B and the side of an end 1Da of the coil fragment 1D, the edge face of one end 1Ca of the coil fragment 1C and the side of the other end 1Ab of the coil fragment 1A, and the edge face of the other end 1Cb of the coil fragment 1C and the side of an end 1Ea of the coil fragment 1E, can be each welded to each other by beam welding, and the beam welding is generally electron-beam welding or laser-beam welding, preferably electron-beam welding. In more detail, by the use of the electron-beam welding, even conductors having high thermal conductivity constituting the coil can be easily and firmly bonded to each other. Further, the welding is carried out in vacuo, and therefore the conductors are not reduced in the electrical conductivity because not oxidized, and they are effectively prevented from defect caused by welding. The bonding means 4 in the bonding step III include fillet weld and brazing, as well as beam welding.

As mentioned above, in the coil fragment forming step I, the strip-shaped coil fragments 1A, 1B, 1C, 1D and 1E constituting each one-turn square coil are prepared by cutting the band-shaped conductive flat plate in a desired length, and hence the resultant coil fragments are enhanced in the processing properties and precision of processing and further the yield of material of the conductive flat plate is enhanced, resulting in improvement of conductivity and reduction of manufacturing cost.

Further, since the ends of the coil fragments 1A, 1B, 1C, 1D and 1E are brought into contact with each other by butting and beam welded whereby a one-turn square coil is prepared, the ends of the coil fragments 1A, 1B, 1C, 1D and 1E can be easily and firmly bonded to one another without formation of padding which is apt to generate by brazing of a conventional method.

The one-turn square coils 1 are superposed on one another with shifting the locations of the notches 3 little by little in order so that the terminal ends 2B and beginning ends 2A of the one-turn square coils adjacent to each other are in contact with each other to weld or braze the terminal and beginning ends in the notches 3, and therefore the one-turn square coils 1 can be superposed on one another without reverse effect of the bonded portions and simultaneously the bonded portions do not come in contact with each another in the direction of the coil axis.

Hence, the one-turn square coils 1 can be bonded to each other by an optional bonding means 4 such as fillet weld or brazing in the notch 3 formed by superposing the terminal end 2B on the beginning end 2A, and simultaneously it can be prevented that a one-turn square coil 1 is bonded to an already bonded portion of another one-turn square coil 1 located under the coil 1, resulting in occurrence of short-circuit. Thus, an edgewise wound square coil having prism-shaped appearance and small interval between coils and showing high quality can be easily prepared in high productivity, which brings about great reduction of manufacturing cost.

Further, there is little interval between the adjacent one-turn square coils and hence the square coil with excellent heat conductivity can be obtained. Therefore the square coil comes to have rapid cooling properties, and further the proportion occupied by coils enhances to make it possible to reduce the size and weight of the electric appliance possible.

Second Embodiment

Figure 6:
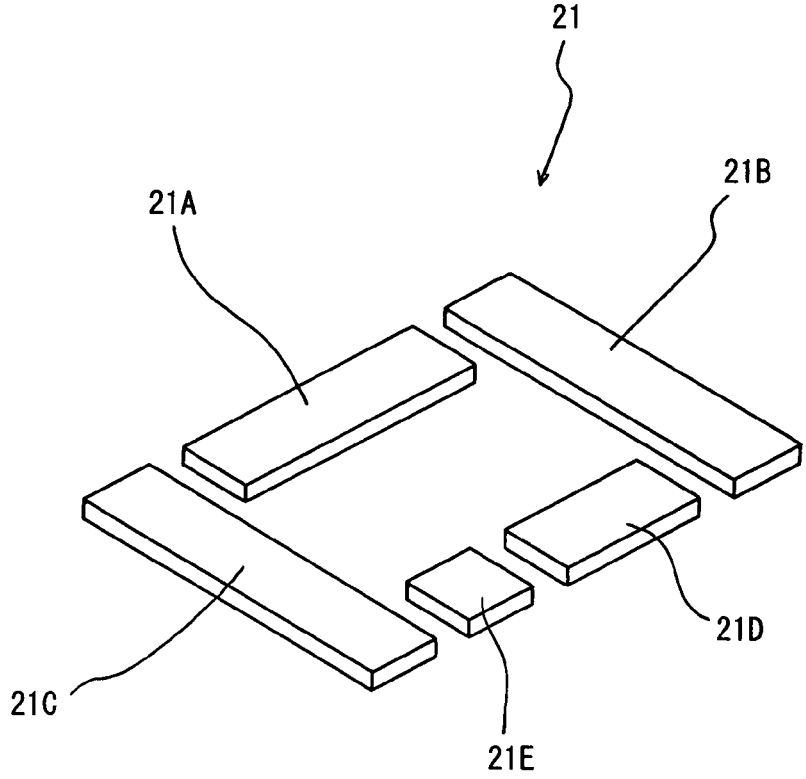
FIG. 6 is a perspective view coil showing coil fragments formed in a coil fragment-forming step in a second embodiment.
Figure 7:
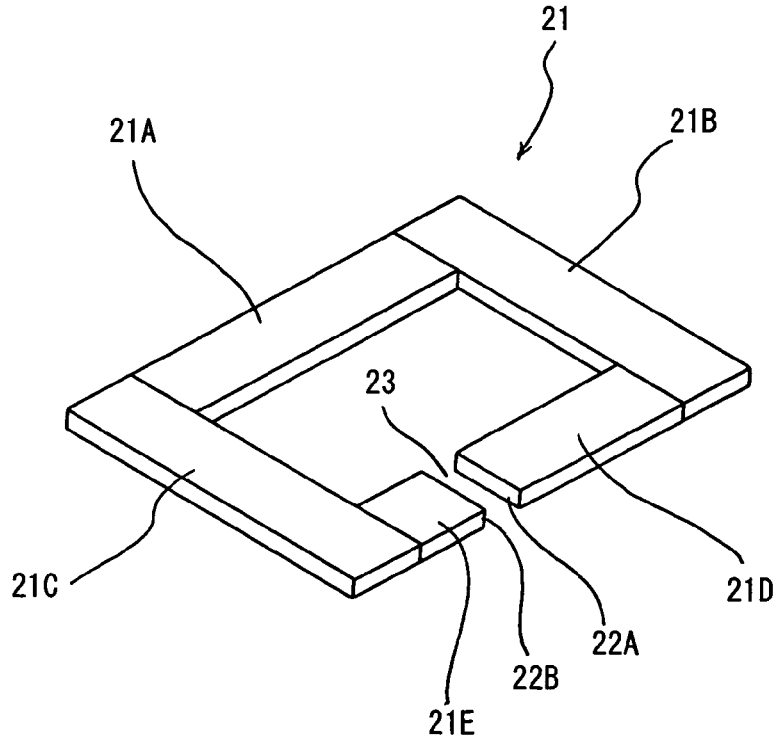
FIG. 7 is a perspective view coil showing a one-turn square coil formed in a one-turn square coil-forming step in the second embodiment.
Figure 8:
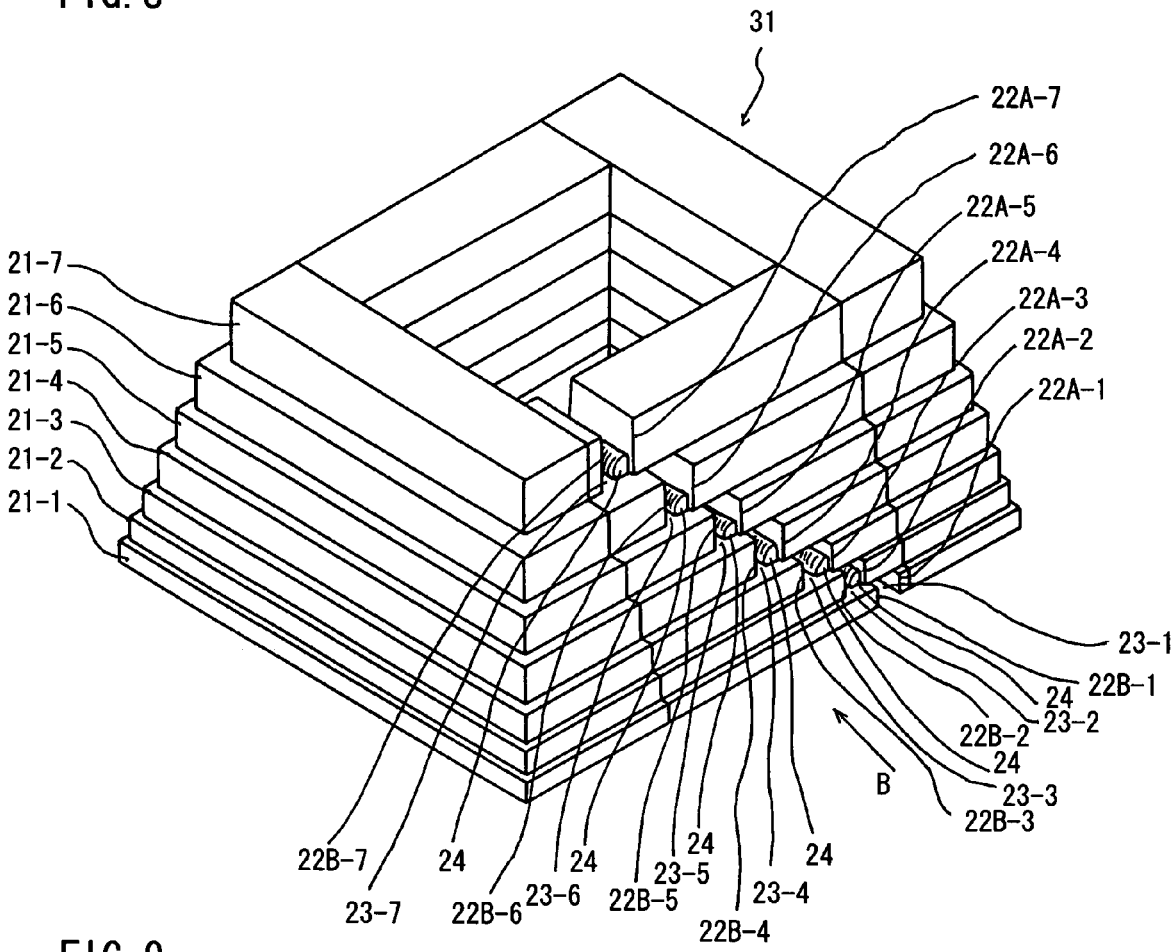
FIG. 8 is a perspective view coil showing an example of a square coil formed in a bonding step in the second embodiment.
Figure 9:
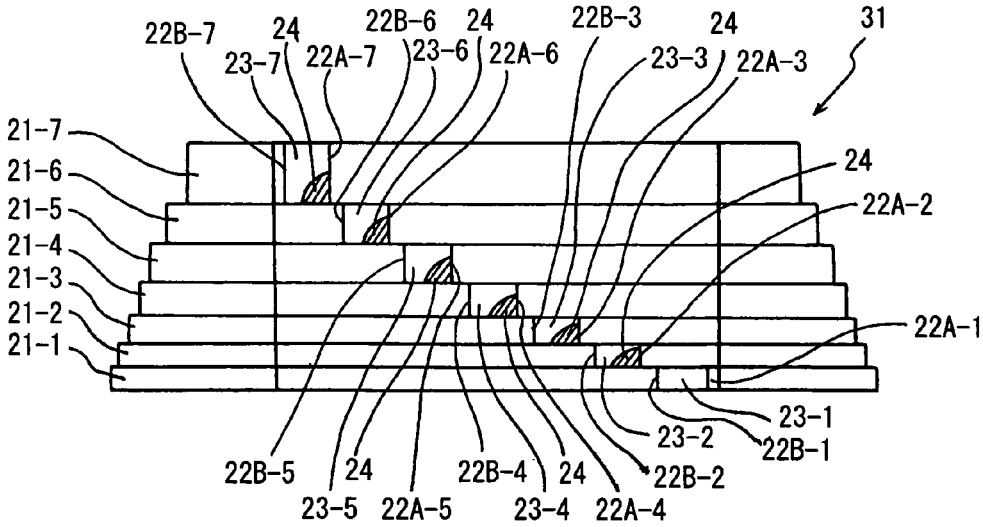
FIG. 9 is a view obtained by viewing FIG. 8 from an arrow B.

FIGS. 6 to 9 show the second embodiment of the invention. FIG. 6 is a perspective view coil showing coil fragments formed in a coil fragment-forming step, FIG. 7 is a perspective view coil showing a one-turn square coil formed in a one-turn square coil forming step, FIG. 8 is a perspective view coil showing an example of a square coil formed in a bonding step, and FIG. 9 is a view obtained by viewing FIG. 8 from an arrow A.

In the embodiment, as the same manner as the first embodiment, a coil fragment-forming step I, one-turn square coil-forming step II, and a bonding step III are carried out in order. In more detail, an edgewise wound square coil can be obtained by winding squarely (i.e., in the form of rectangular) an electric conductor having a rectangular cross section such that small sides of the cross section corresponds with the direction of axis of the coil and consequently helically superposing the conductor while increasing or reducing the outer size with movement in the direction of the coil axis.

In the coil fragment-forming step I, plural electrically conductive flat plates, made of metal such as copper or aluminum, having a rectangular cross section and band-shape and having different thickness from one another and the same section area as one another is cut in the desired length to prepare five strip-shaped coil fragments 21A to 21E every thickness, the fragments forming a one-turn square coil 21 as shown in FIG. 6.

In each of the one-turn square coils 21, its outer size is reduced with increase of the thickness of the electrically conductive flat plate, and simultaneously the lengths of the coil fragments 21D and 21E are changed every each of the one-turn square coils 21 such that the locations of the notches 23 of the one-turn square coils 21 are shifted in thickness order of the electrically conductive flat plates.

Subsequently, in the one-turn square coil forming step II, as shown in FIG. 7, the strip-shaped coil fragments 21A to 21E having the same thickness prepared in the coil fragment-forming step I are brought into contact with each other by butting them and bonded to each other by welding of electron or laser beam in the same manner as in the first embodiment, whereby a one-turn square coil 21 formed by continuously connecting the coil fragments 21D, 21B, 21A, 21C and 21E provided that the beginning end 22A and the terminal end 22B are decoupled by the notch 23 is formed. Similarly, the location of the notch 23 formed by the beginning end 22A and the terminal end 22B is shifted in thickness order, and consequently plural one-turn square coils 21 in which the outer size is reduced with increase of the thickness are prepared.

In the embodiment, both edge faces of the coil fragments 21A are brought into contact with one end sides of the coil fragments 21B and 21C by butting them such that the short coil fragments 21B and 21C are connected each other through the long coil fragments 21A and 21D, and 21E, and an edge face opposite to a beginning end 22A of the coil fragment 21D is brought into contact with the other end side of the coil fragment 21B and further an edge face opposite to a terminal end 22B of the coil fragment 21E is brought into contact with the other end side of the coil fragment 21C, and then these contacted portions are welded, whereby a one-turn square coil is prepared.

Subsequently, in the bonding step III, the plural one-turn square coils 21 prepared in the above one-turn square coil forming step I are superposed with shifting the locations of the notches 23 in order, and the terminal ends 22B and the beginning ends 22A of the one-turn square coils 21 adjacent to each other are contact with each other to bond the terminal and beginning ends by optional bonding means 24 such as fillet weld or brazing in the same manner as the first embodiment, whereby a edgewise wound square coil, in which the outer sizes of the bonded square coils increase or reduce with the movement of the one-turn square coils in the direction of coil axis, is prepared.

In more detail, as shown in FIGS. 8 and 9, for example, in case of spirally bonding seven one-turn square coils 21-1 to 21-7 to prepare a square coil 31, the seven one-turn square coils 21-1 to 21-7 are bonded to one another such that the thicknesses of the bonded square coils increase and the outer sizes of the bonded square coils reduce in order with the movement of the one-turn square coils in the direction of coil axis. First, the one-turn square coil 21-2 is superposed on the one-turn square coil 21-1 such that the terminal end 22B-1 of the one-turn square coil 21-1 and the beginning end 22A-1 of the next one-turn square coil 21-2 are contact with each other, and then the terminal end 22B-1 and the beginning end 22A-1 are bonded in a notch 23-2 of the one-turn square coil 21-2 by optional bonding means 24 such as fillet weld or brazing.

Similarly, the one-turn square coil 21-3 is superposed on the one-turn square coil 21-2 as above, and hence the terminal end 22B-2 of the one-turn square coil 21-2 and the beginning end 22A-3 of the next one-turn square coil 21-3 are bonded in a notch 23-3 of the one-turn square coil 21-3 by bonding means 24 such as fillet weld or brazing.

The above bonding processing is carried out in every case of superposing each of the one-turn square coils 21-4 to 21-7. Thus the one-turn square coils 21-1 to 21-7 are superposed as above and spirally bonded, whereby a square coil 31 in which the outer size is reduced with movement of from the one-turn square coil 21-1 to the one-turn square coil 21-7 is prepared. Thereafter each gap between two of the one-turn square coils 21-1 to 21-7 is subjected to insulation treatment according to a known process.

As mentioned above, in the coil fragment forming step I, the strip-shaped coil fragments 21A to 21E constituting each one-turn square coil are prepared by cutting each of the band-shaped conductive flat plates having different thickness from one another and approximately the same section area as one another in a desired length, and consequently a strip-shaped one-turn coil fragments 21A to 21E constituting a one-turn square coil 21 are obtained every each thickness. Hence, the resultant coil fragments are enhanced in the processing properties and precision of processing and further the yield of material of the conductive flat plate is enhanced, resulting in improvement of conductivity and reduction of manufacturing cost.

Further, since the outer size of the square coil 31 gradually reduces with the movement from the one-turn square coil 21-1 to the one-turn square coil 21-7, i.e., the outer size of the square coil 31 is gradually increases with the movement from the one-turn square coil 21-7 to the one-turn square coil 21-1 to form the appearance in the form of taper, for example, the use of the square coil 31 as a stator coil of a motor makes it possible to attach a slot between cores of the stator to each of the cores with leaving the minimum path for heat dissipation. Hence, it is possible to enhance the proportion occupied by coil to improve operation efficiency of a motor and therefore to reduce of the size and weight of the motor and the manufacturing cost. Furthermore, the use of the square coil for rotating apparatuses (e.g., a generator) or other electric appliances also enables reduction of the size and weight of the motor and the manufacturing cost.

Figure 10:
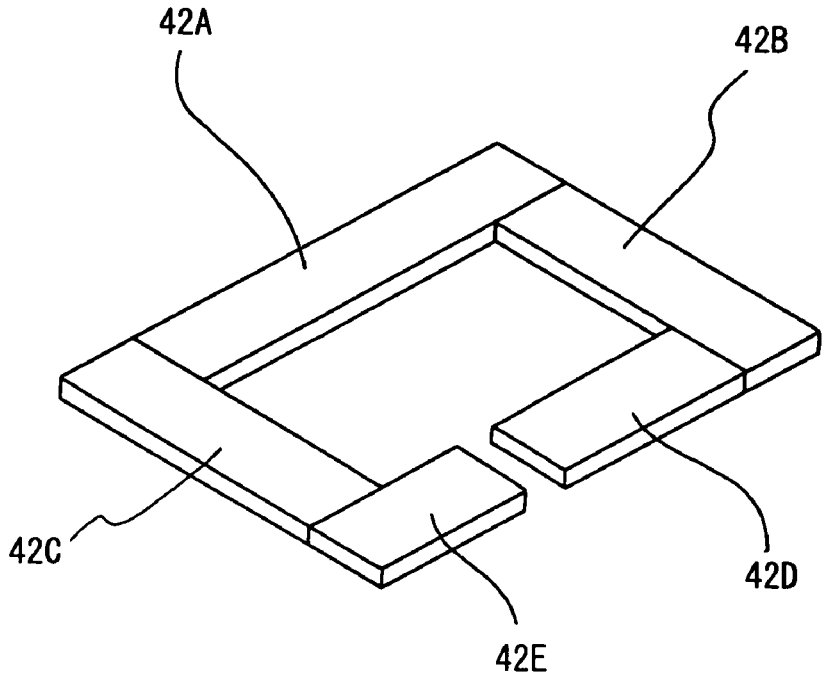
FIG. 10 is a view showing a variant of the one-turn square coil of the invention.

The constitutions of the present invention can be altered without being restricted to the first and second embodiments, so long as the alteration is not deviated from the gist of the invention. For example, the number of the one-turn square coils to be superposed may be not restricted to seven, and other number can be adopted. The one-turn square coils can be bonded in order as shown in FIG. 10, and therefore the one-turn square coils 43A and the one-turn square coils 42D, 42E may not be bonded to each other through the one-turn square coils 42B, 42C.

Figure 11:
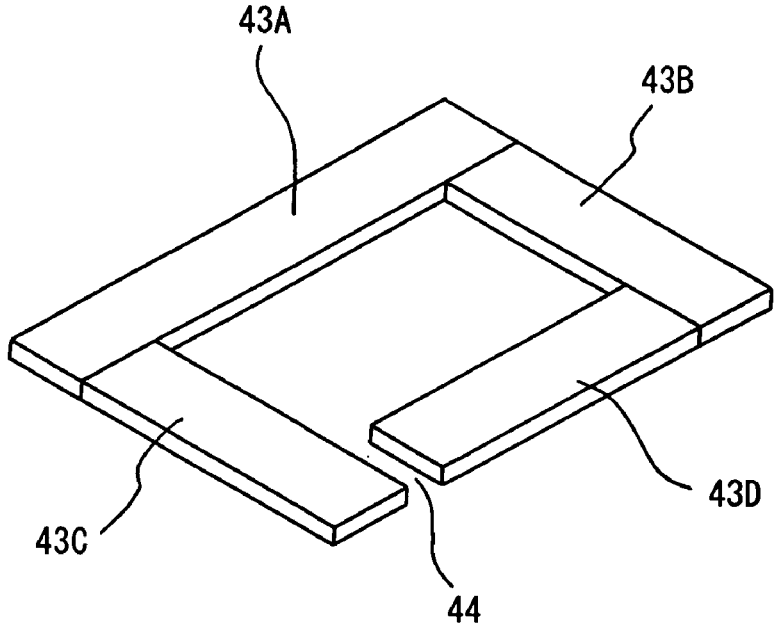
FIG. 11 is a view showing another variant of the one-turn square coil of the invention.
Figure 12:
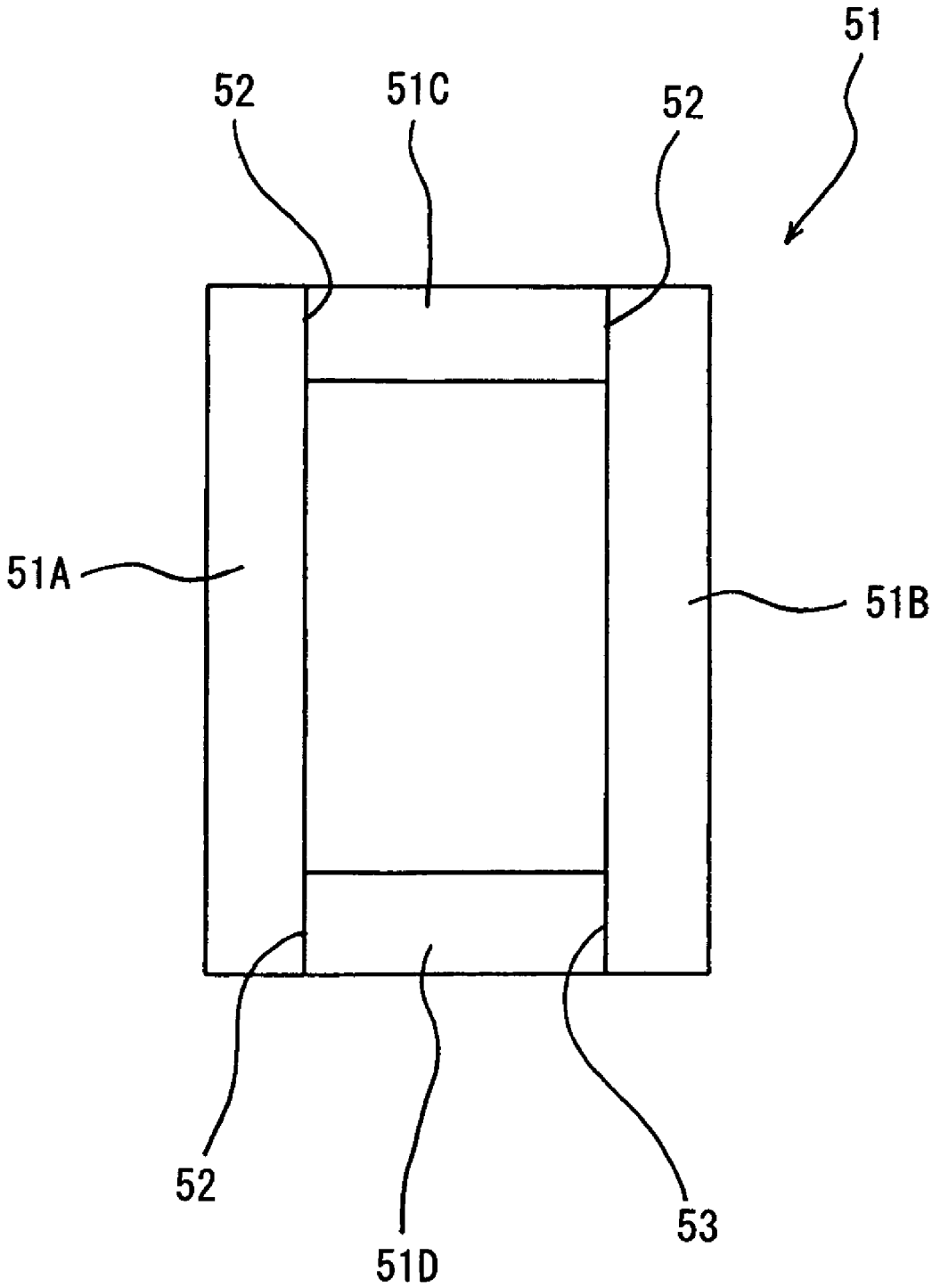
FIG. 12 is a view for explaining a conventional process for the preparation of a coil for motor.

Further, in a first one-turn square coil to start the turning and a last one-turn square coil to complete the turning in the plural one-turn square coils constituting a square coil, for example, as shown in FIG. 11, four coil fragments 43A to 43D instead of five coil fragments can form a one-turn square coil such that a notch 44 is formed between the coil fragments 43D and 43C. Thereby, one of coil fragments constituting a one-turn square coil can be omitted and therefore the number of steps for welding can be reduced, resulting in reduction of the manufacturing cost.

Moreover, though a shape of the one-turn square coil is rectangular in the above description, the shape may be regular square, or four angles of the periphery of the one-turn square coil may be processed to in the form of arc. Further, though the coil fragments are prepared by cutting the belt-shaped electrically conductive flat plate in the above description, it can be also prepared by subjecting a conductive flat plate having relatively large area to a shearing processing, a presswork, or mechanical processing such as milling.

EFFECT OF THE INVENTION

As described above, according to the present invention, the coil for an electric appliance comprising an edgewise wound square coil is prepared by mechanically processing an electrically conductive flat plate to form plural strip-shaped coil fragments, butting ends of the coil fragments each other and beam welding the ends to form plural one-turn square coils, each of the one-turn square coils having a beginning end and a terminal end divided by a notch whose location is different from one another in the one-turn square coils, and superposing the one-turn square coils on one another while shifting the locations of the notches little by little in order so that the terminal and beginning ends of the one-turn square coils adjacent to each other are contact with each other to weld or braze the terminal and beginning ends, whereby the one-turn square coils are spirally bonded. Therefore there is no occurrences of short-circuit between one-turn square coils, the short-circuit having occurred in conventional coils, and hence it is possible to easily and firmly bond the coil fragments to each other and the one-turn square coils to each other. Thereby, it is possible to easily prepare coils for electric appliances comprising an edgewise wound square coil having high quality and small intervals between coils in good productivity and low-cost.

The disclosure of Japanese Patent Application No. 2003-209005, dated Aug. 27, 2003, including the specification, drawings and abstract, is hereby incorporated by reference in its entirety.

While the presently preferred embodiments of the present invention have been shown and described, it is to be understood that disclosures are for the purpose of illustration and that various changes and modification may be made without departing from the scope of the invention as set forth in the appended claims.

What is claimed is:

1. A process for the preparation of a coil for an electric appliance by winding an electric conductor having a rectangular cross section such that small sides of the cross section corresponds with the direction of the coil axis of the coil to helically superpose the conductor, comprising the steps of:

providing electrically conductive plural strip-shaped coil fragments;

butting ends of the coil fragments to each other and beam welding the ends to form plural one-turn coils having notches whose locations differs from one another, each of the one-turn coils having a ring-shape provided with a beginning end and a terminal end divided by the notch; and superposing the one-turn coils on one another while shifting the locations of the notches little by little in order so that the terminal and beginning ends of the one-turn coils adjacent to each other are in contact with each other to weld or braze the terminal and beginning ends, whereby the one-turn coils are spirally bonded.

2. A process for the preparation of a coil for an electric appliance as defined in claim 1, wherein the formed plural one-turn coils have the same outer size as one another.

3. A process for the preparation of a coil for electric appliance as defined in claim 1, wherein the formed plural one-turn coils have an outer size different from one another and different location of the notch from one another.

4. A process for the preparation of a coil for electric appliance as defined in claim 3, wherein providing of the plural strip-shaped coil fragments includes cutting plural electrically conductive flat plates in the form of a band in a desired length, the plural electrically conductive flat plates having thickness different from one another and approximately the same sectional area as one another.

5. A process for the preparation of a coil for an electric appliance as defined in claim 3, wherein superposing of the one-turn coils includes superposing the one-turn coils on one another while shifting the locations of the notches little by little with increase or decrease of outer sizes of the one-turn coils.

6. A process for the preparation of a coil for an electric appliance as defined in claim 1, providing the strip-shaped coil fragments includes cutting an electrically conductive flat plate into the form of a band in a desired length.

7. A process for the preparation of a coil for an electric appliance as defined in claim 1, wherein the one turn coils have corners that are arc shaped.

8. A process for the preparation of a coil for an electric appliance as defined in claim 1, wherein the one-turn coils have a rectangular shape.

9. A process for the preparation of a coil for an electric appliance as defined in claim 1, wherein the one-turn coils have a square shape.

10. A coil for an electric appliance obtained by winding an electric conductor having a rectangular cross section such that small sides of the cross section correspond with the direction of the coil axis of the coil to helically superpose the conductor, comprising:

plural one-turn coils having notches whose locations differs from one another and each of the one-turn coils having a ring-shape provided with a beginning end and a terminal end divided by the notch, the plural one-turn coils being superposed on one another while shifting the locations of the notches little by little so that the terminal and beginning ends of the one-turn coils adjacent to each other are in contact with each other to weld or braze the terminal and beginning ends, whereby the one-turn coils are spirally and continuously bonded.

11. A coil for an electric appliance as defined in claim 10, wherein the plural one-turn coils are obtained by butting ends of the strip-shaped coil fragments made of an electrically conductive flat plate with each other in order and beam welding the ends.

12. A coil for an electric appliance as defined in claim 10, wherein the plural one-turn coils have the same outer size as one another.

13. A coil for an electric appliance as defined in claim 10, wherein the plural one-turn coils have an outer size different from one another and different location of the notch from one another.

14. A coil for an electric appliance as defined in claim 13, wherein the plural one-turn coils are superposed on one another with increase or decrease of outer sizes of the one-turn coils.

15. A coil for an electric appliance as defined in claim 10, wherein the one-turn coils have a rectangular shape.

16. A coil for an electric appliance as defined in claim 10, wherein the one-turn coils have a square shape.

17. A coil for an electric appliance as defined in claim 10, wherein the one turn coils have corners that are arc shaped.

* * * * *